US010227815B2

(12) United States Patent
Rocca, Jr. et al.

(10) Patent No.: US 10,227,815 B2
(45) **Date of Patent: *Mar. 12, 2019**

(54) WINDOW JAMB EXTENDER FOR NEW OR REPLACEMENT WINDOW

(71) Applicant: WINJET, LLC, Berea, OH (US)

(72) Inventors: Samuel Mark Rocca, Jr., Cortland, OH (US); Todd R. Schmidt, Valley View, OH (US); Russell E. Schmidt, Avon Lake, OH (US); Timothy E. Felker, Westlake, OH (US)

(73) Assignee: WINJET, LLC, Berea, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/621,700

(22) Filed: Jun. 13, 2017

(65) Prior Publication Data

US 2017/0356236 A1 Dec. 14, 2017

Related U.S. Application Data

(63) Continuation-in-part of application No. 15/356,409, filed on Nov. 18, 2016, now Pat. No. 10,125,532.
(Continued)

(51) Int. Cl.
*E06B 1/04* (2006.01)
*E06B 1/68* (2006.01)
(Continued)

(52) U.S. Cl.
CPC ..... *E06B 1/68* (2013.01); *E06B 1/342* (2013.01); *E06B 1/34* (2013.01); *E06B 1/62* (2013.01); *E06B 2001/622* (2013.01)

(58) Field of Classification Search
CPC ..... E06B 1/68; E06B 1/342; E06B 2001/622; E06B 1/34; E06B 1/62
(Continued)

(56) References Cited

U.S. PATENT DOCUMENTS 3,583,114 A 6/1971 Belfor
3,997,025 A 12/1976 Price
(Continued)

OTHER PUBLICATIONS

International Search Report dated Sep. 1, 2017 for International application No. PCT/US17/37278.
(Continued)

*Primary Examiner* — Basil S Katcheves
(74) *Attorney, Agent, or Firm* — Fay Sharpe LLP

(57) ABSTRACT

A window jamb extender includes a frame including: (i) a first leg including opposite inner and outer ends; and, (ii) a second leg connected to the outer end of the first leg and arranged transversely relative to the first leg. The first leg includes an outer face adapted to be abutted with an associated wall stud that partially defines a periphery of an opening in an associated wall structure. The first leg includes an inner face that is opposite the outer face and that is adapted to lie adjacent an outer peripheral wall of an associated window frame. The second leg includes an inner face adapted to lie adjacent an exterior face of the associated window frame. The window jamb extender further includes a J-channel portion including: (i) a primary flange that projects outwardly from the outer face of said first leg; and, (ii) a secondary flange that projects outwardly from the outer face of said first leg, wherein the secondary flange is spaced-apart from the primary flange.

19 Claims, 8 Drawing Sheets

Related U.S. Application Data

(60) Provisional application No. 62/392,878, filed on Jun. 13, 2016.

(51) Int. Cl.
*E06B 1/34* (2006.01)
*E06B 1/62* (2006.01)

(58) Field of Classification Search
USPC ..... 52/204.1
See application file for complete search history.

(56) References Cited

U.S. PATENT DOCUMENTS

| | | | |
|---|---|---|---|
| 4,267,673 | A | 5/1981 | Coulston |
| 4,328,644 | A | 5/1982 | Scott et al. |
| 4,694,612 | A | 9/1987 | Pruden et al. |
| 5,392,574 | A | 2/1995 | Sayers |
| 5,555,684 | A | 9/1996 | Galowitz et al. |
| 5,581,970 | A | 12/1996 | O'Shea |
| 5,603,585 | A | 2/1997 | Bruchu et al. |
| 5,941,033 | A | 8/1999 | Adams |
| 6,427,398 | B1 | 8/2002 | Levine et al. |
| 6,725,610 | B2 | 4/2004 | Murphy et al. |
| 6,763,638 | B1 | 7/2004 | Berger, Jr. |
| 7,284,353 | B2 | 10/2007 | Bealko |
| RE40,041 | E | 2/2008 | Sayers |
| RE40,141 | E | 2/2008 | Sayers |
| 7,631,465 | B2 | 12/2009 | Curtis |
| 7,874,106 | B2 | 1/2011 | Pangburn et al. |
| 8,024,898 | B2 | 9/2011 | Alvarado |
| 8,607,514 | B2 | 12/2013 | Peterson |
| 8,984,820 | B1 | 3/2015 | Kownacki et al. |
| 2003/0056450 | A1 | 3/2003 | Bealko |
| 2004/0010989 | A1 | 1/2004 | Rivest |
| 2004/0187408 | A1 | 9/2004 | Smith |
| 2004/0226232 | A1 | 11/2004 | Engebretson |
| 2005/0072073 | A1 | 4/2005 | Inelli |
| 2006/0143996 | A1 | 6/2006 | Alvarado |
| 2007/0277455 | A1 | 12/2007 | Flanigan et al. |
| 2009/0044466 | A1 | 2/2009 | Andres |
| 2012/0055107 | A1 | 3/2012 | Butler et al. |
| 2014/0123589 | A1 | 5/2014 | Yeomans et al. |
| 2017/0356234 | A1* | 12/2017 | Rocca, Jr. ..... E06B 1/02 |

OTHER PUBLICATIONS

Written Opinion dated Sep. 1, 2017 for International application No. PCT/US17/37278.

Office Action for co-pending U.S. Appl. No. 15/356,409 dated Jun. 19, 2017.

Notice of Co-pending U.S. Appl. No. 15/356,409, filed Nov. 18, 2016.

* cited by examiner

WINDOW JAMB EXTENDER FOR NEW OR REPLACEMENT WINDOW

CROSS-REFERENCE TO RELATED APPLICATIONS

This application is a continuation-in-part of U.S. application Ser. No. 15/356,409 filed Nov. 18, 2016, which claims priority from and benefit of the filing date of U.S. provisional application Ser. No. 62/392,878 filed Jun. 13, 2016. This application also claims priority from and benefit of the filing date of U.S. provisional application Ser. No. 62/392,878 filed Jun. 13, 2016. The entire disclosures of both U.S. application Ser. No. 15/356,409 filed Nov. 18, 2016 and U.S. provisional application Ser. No. 62/392,878 filed Jun. 13, 2016 are hereby expressly incorporated by reference into the present specification.

FIELD

The present invention relates to a device to modify jamb dimensions to ease carpentry work on windows. More particularly, the present invention relates to a window jamb extender configured to allow installation of new windows, either as replacement windows in an existing home or other structure, or as new windows installed during construction of a home or other structure.

BACKGROUND

Replacement or retrofit windows are sometimes installed using an "insert" replacement method in which the existing window is removed but the master window frame is left intact and in position. The replacement window is then inserted into and secured in the existing master window frame. This insert method eliminates labor associated with removing and replacing the master frame, including all of the interior and exterior trim work.

Alternately, replacement windows are sometimes installed using a "full frame" replacement method that includes completely removing the existing master window frame down to jack studs, and installing the replacement window including a new window frame.

Existing windows are constructed of a wide variety of materials, for example, wood, or non-wood type such as vinyl or metal. Conventionally, full frame replacements are best practiced when working with non-wood existing windows. This often requires additional labor and materials to complete the installation compared to the insert replacement method.

Vinyl frame windows have been widely used for several decades in new construction. These vinyl frame windows typically include a J-channel that is integral with the frame to provide a space for receiving siding or other exterior facing of the structure, and also typically include an integral nailing flange for being secured to the house or other structure. Such vinyl frame windows have a relative thinness or narrowness between the interior and exterior sides of the window frame. As such, when they are installed in the window frame or jamb of a new structure with their exterior side approximately even or "flush" with the exterior building wall, the interior side of the vinyl window frame is spaced inward only about 2 inches from the exterior wall of the structure, which is about 1-inch to 1¼-inch less than other (non-vinyl) windows. In other words, the interior side of such vinyl frame new construction windows are recessed significantly greater relative to the interior wall of the home or other structure as compared to wood frame windows.

On the other hand, replacement windows having a vinyl frame or other frame are typically thicker as compared to these new construction vinyl frame windows as measured between the interior and exterior faces of the window frame. Attempting to install these replacement windows in the existing master frame or jamb of the structure causes various problems. More particularly, the "jamb mounting depth" (defined as the dimension measured from the interior face of the window frame to the exterior wall of the house or other structure) is typically about 2 inches for structures originally constructed with vinyl frame windows. In contrast, a replacement window frame is normally 3¼-inches thick between the interior and exterior faces of the window frame, so such a replacement window will not fit in the existing jamb mounting depth of the structure.

Currently, there are different methods for installing a replacement window when the existing jamb mounting depth is too small to fit the replacement window. The first method includes increasing the jamb mounting area to the interior of the house. If the jamb mounting area is increased to the interior of the home, additional carpentry and finish work is required for interior casing, drywall work, painting, staining, new interior casing, new or relocated window treatments, and other such interior finish work. Such interior finish work is costly, disruptive to the homeowner or other occupant, and otherwise undesirable.

The second method includes extending the jamb with lumber to increase the jamb mounting area to the exterior of the building. If the jamb mounting area is extended to the exterior in this manner, this also requires additional carpentry to fabricate new wood jamb extensions inside of the existing house framing and reduces the rough opening size for the new replacement window resulting in a smaller window with less visible glass area. On the exterior, extensive trim work is commonly required, including but not limited to, careful removal and reinstallation of existing siding or cladding to remove the existing window and install new J-channel, trim work required to cover exterior stops and jamb extensions if used. As such, this second method is also undesired.

The third method includes selecting a replacement window that is dimensioned and structured in a manner that corresponds closely to the original window being replaced and including an integral nail flange and J-channel, and having a similar jamb depth. Finding or manufacturing such windows that fit an existing jamb mounting depth can increase cost and are commonly less energy efficient. Also, when a replacement window with an integral nail flange is used, there is less interior carpentry work than in other methods since the jamb depth is the same but there is still extensive exterior work that must be done, including but not limited to, careful removal and reinstallation of exterior cladding, and fastening and sealing the new integral nail flange to the building. This cladding removal, frequently vinyl siding, is difficult because if a piece of siding is damaged and needs to be replaced it is difficult to match siding that has faded or may no longer be available from the original manufacturer. Overall, the exterior cladding work required to remove and reinstall the cladding around every window in the home, around existing landscaping, variable exterior grading, working with scaffolding when required, is very time and cost intensive. As such, to efficiently replace these vinyl new construction windows with replacement windows, a full frame replacement has heretofore been the best practice as the existing window master frames cannot be used and must be completely removed for the reasons described. Hence, there is a long felt but unresolved need for an apparatus and method that prevent the need for increasing the jamb mounting area to the interior of the home. Moreover, there is a need for an apparatus and method that prevent the need for increasing the jamb mounting area to the exterior of the home without extensive carpentry and lumber. Furthermore, there is a need for an apparatus and method that prevents the need for extensive exterior work of the home.

SUMMARY OF THE INVENTION

A window jamb extender includes a frame including: (i) a first leg including opposite inner and outer ends; and, (ii) a second leg connected to the outer end of the first leg and arranged transversely relative to the first leg. The first leg includes an outer face adapted to be abutted with an associated wall stud that partially defines a periphery of an opening in an associated wall structure. The first leg includes an inner face that is opposite the outer face and that is adapted to lie adjacent an outer peripheral wall of an associated window frame. The second leg includes an inner face adapted to lie adjacent an exterior face of the associated window frame. The window jamb extender further includes a J-channel portion including: (i) a primary flange that projects outwardly from the outer face of said first leg; and, (ii) a secondary flange that projects outwardly from the outer face of said first leg, wherein the secondary flange is spaced-apart from the primary flange.

DETAILED DESCRIPTION

Figure 1A:
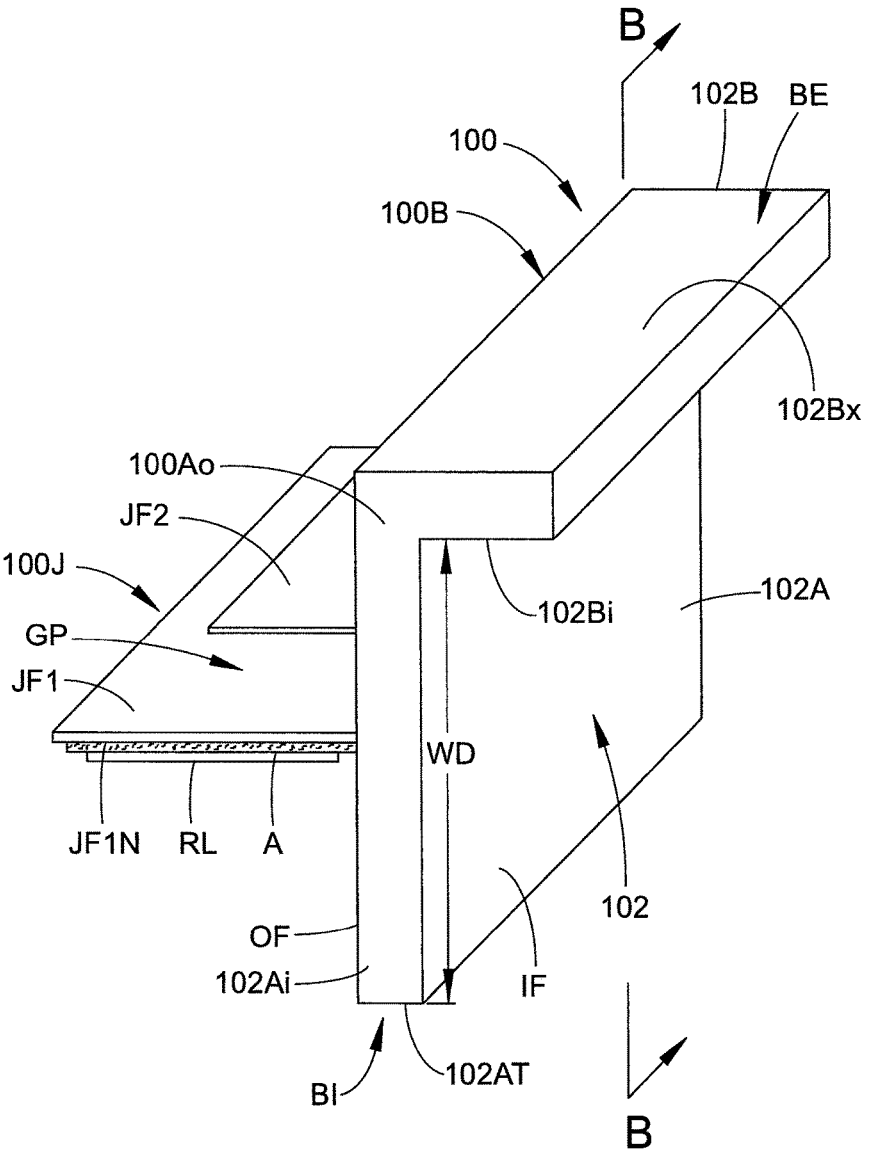
FIG. 1A is a front isometric view of a window jamb extender provided in accordance with a first embodiment of the present development.
Figure 1B:
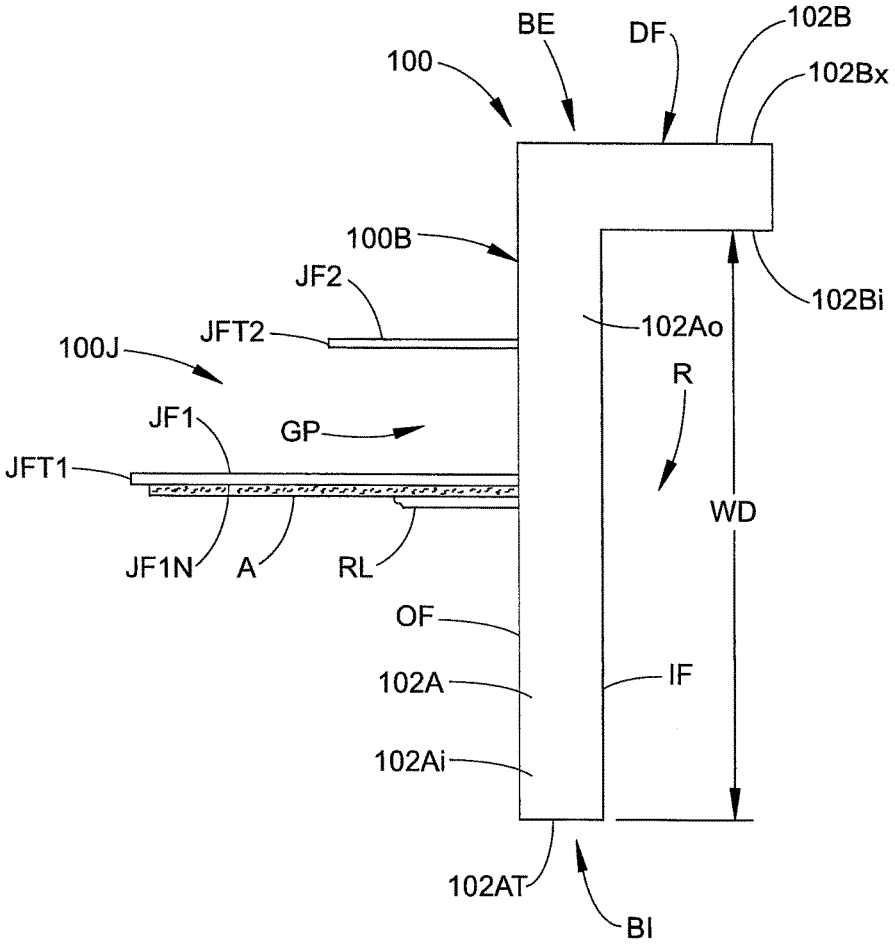
FIG. 1B is a section view of the window jamb extender of FIG. 1A as taken along line B-B thereof.

FIGS. 1A and 1B illustrate a window jamb extender 100 formed in accordance with a first embodiment of the present development. In a typical arrangement, as described in more detail below, four separate sections of the window jamb extender 100 are installed in a window opening of an associated wall of a house or other structure and arranged in a rectangular shape to construct a master window frame within which a vinyl frame or other new or replacement window can be operatively installed in a manner that eliminates or minimizes finish work on the interior side of the window.

Figure 2:
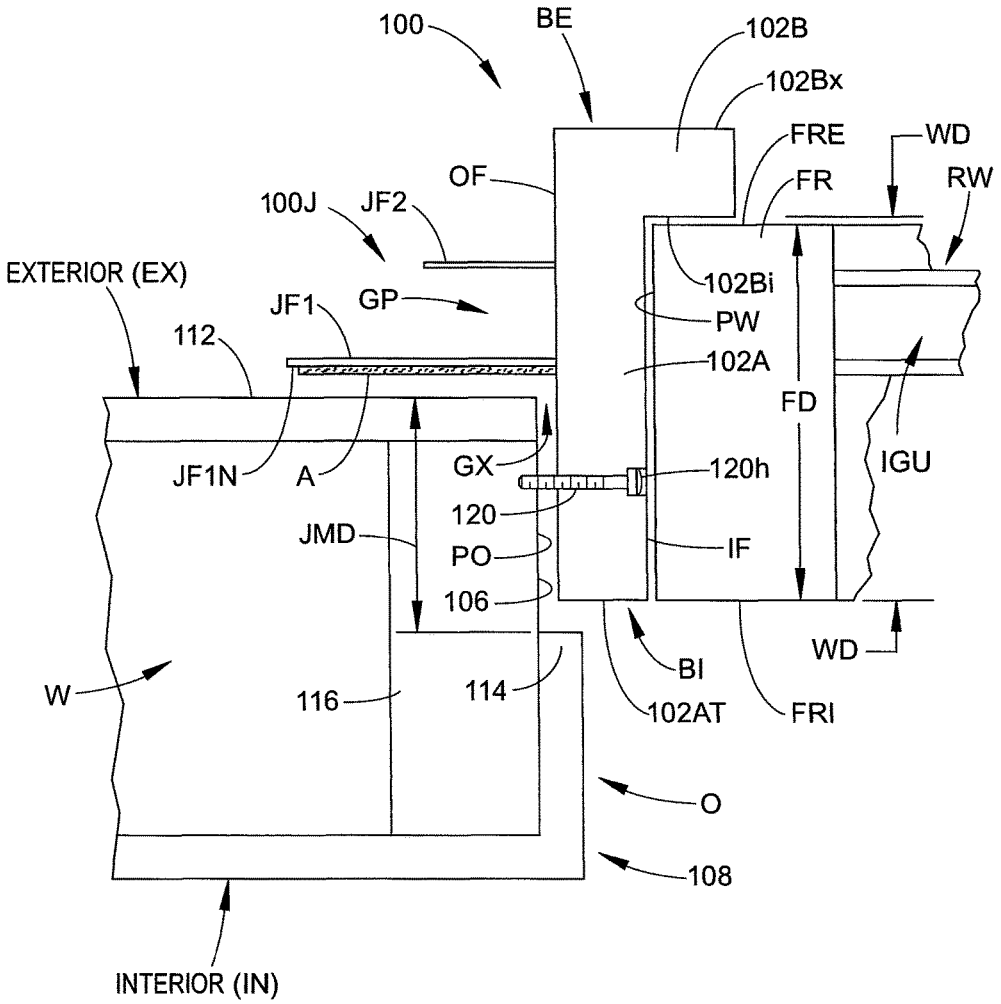
FIG. 2 is a section view of the window jamb extender similar to FIG. 1B as operative installed in a window opening of an associated wall of a house or other structure (a small space is shown between the window jamb extender and the wall to facilitate an understanding of the structure, and this space is not present when the window jamb extender is actually installed in an opening of a wall structure)

Referring also to FIG. 2, the window jamb extender 100 overcomes the deficiencies associated with known window installation methods and structures by providing a structure that accommodates a frame FR of a replacement window within an existing jamb mounting depth JMD of a window jamb 106 existing in an opening O of an associated wall structure W of a house or other structure as shown in FIG. 2.

The window jamb extender 100 in the present embodiment comprises an extruded one piece polymeric body 100B comprising and defining the profile as shown in FIG. 1B and FIG. 2. The body 100B comprises a generally L-shaped frame structure 102 including a first or primary leg 102A and a second or secondary leg 102B arranged perpendicularly or otherwise transversely relative to the first leg 102A. The first leg 102A includes opposite inner and outer ends 102Ai, 102Ao, and the second leg 102B is connected to the outer end 102Ao of the first leg 102A. The first leg 102A also includes opposite inner and outer faces IF,OF that are spaced-apart and directed outwardly away from each other. The second leg 102B includes opposite inner and outer faces 102Bi,102Bx. The respective inner faces IF,102Bi of the first and second legs 102A,102B are preferably arranged perpendicularly relative to each other. The first leg 102A is preferably and typically longer the second leg 102B because an inner face IF of the first leg 102A is intended to lie adjacent the outer periphery or outer peripheral wall PW of the frame FR an associated window RW being installed, while the second leg 102B is intended to abut the exterior face FRE of the window frame FR window RW being installed to act as a stop with minimal overlap for improved aesthetics. The frame FR of the replacement window RW holds one or more glass or other transparent window panes such as one or more insulated glass units IGU.

The body 100B of the window jamb extender 100 includes an interior side BI that is oriented toward the interior surface IN (FIG. 2) of the house/structure wall W (away from the exterior surface EX) when the window jamb extender 100 is operatively installed, and the body 100B also includes an opposite exterior side BE that faces outwardly away from the exterior surface EX of the house/structure wall W when the window jamb extender 100 is operatively installed.

Figure 3:
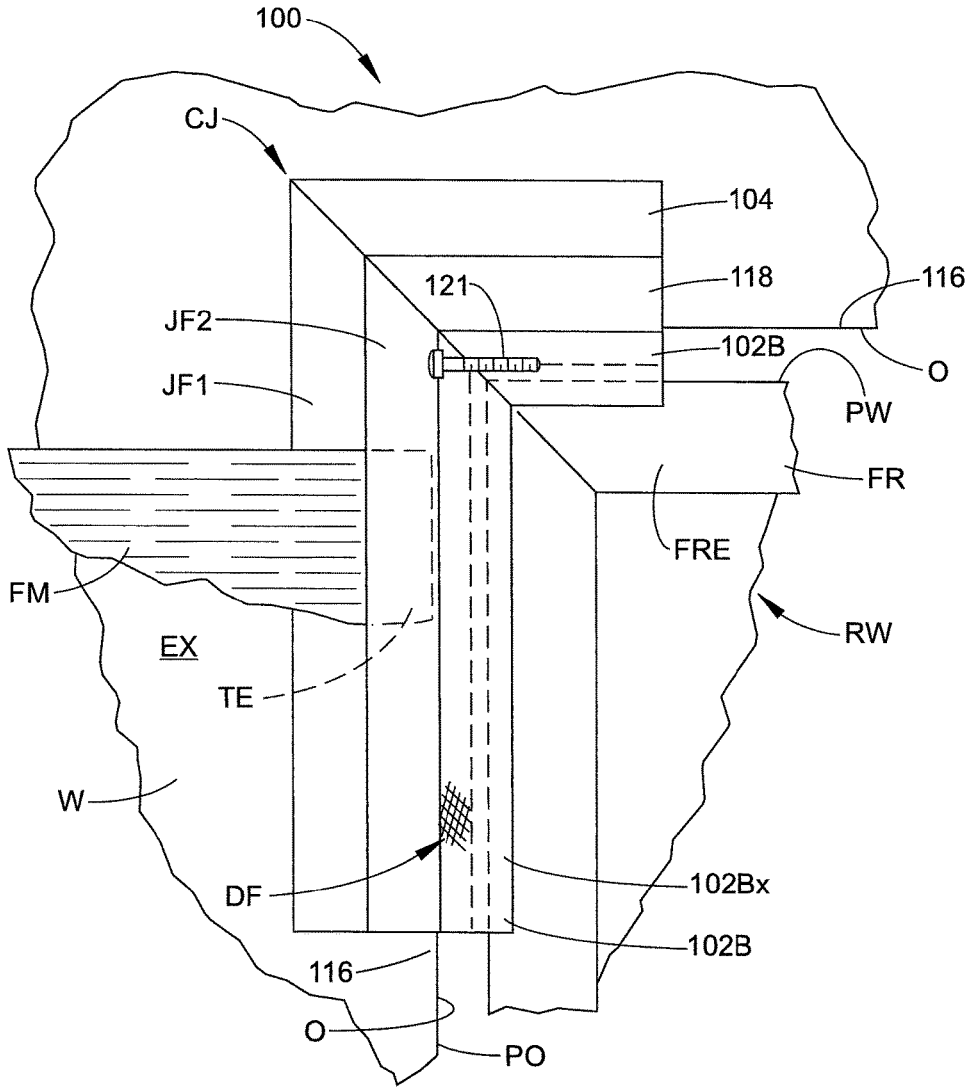
FIG. 3 is a front (exterior) elevation view that illustrates first and second window jamb extenders each formed in accordance with FIG. 1A and operatively connected together to form a corner bevel joint of a window frame installed in the opening of the associated wall structure.

In the embodiment of FIGS. 1A and 1B, the one-piece monolithic polymeric body further comprises a J-channel portion 100J provided a part thereof. The J-channel portion 100J, itself, comprises and is defined by a first or primary flange JF1 and a second or secondary flange JF2 that is spaced-part from and preferably arranged parallel to the primary flange JF1. The primary and secondary flanges JF1,JF2 both project outwardly in a transverse manner from the outer face OF the first leg 102A, preferably both perpendicularly relative to the outer face OF. The primary flange JF1 is located closer to the interior side BI of the body 100B as compared to the secondary flange JF2, i.e., the primary flange JF1 is closer to the inner end 102Ai of the first leg 102A as compared to the secondary flange JF2, and the secondary flange JF2 is closer to the outer end 102Ao of the first leg 102A as compared to the primary flange JF1. The secondary flange JF2 is preferably shorter than the primary flange JF1 when measured from the outer face OF to the outer end or tip JFT1,JFT2 of the respective flanges JF1,JF2. As shown in FIGS. 2 and 3 and described further below, the primary flange JF1 is adapted to be abutted with the house/structure wall exterior surface EX, and the secondary flange is spaced outwardly from the house/structure exterior surface EX when the jamb extender 100 is installed such that a siding or facing installation gap GP is defined between the flanges JF1,JF2, wherein the gap GP is adapted to receive the terminal end TE (FIG. 3) of vinyl siding, aluminum siding, or other facing members or cladding members FM such that a space defined where the siding/facing/cladding members lie adjacent the outer face OF of the jamb extender body 100B is concealed behind/beneath the secondary flange F2.

In the illustrated embodiment, an inner face JF1N of the primary flange JF1 includes a self-adhesive seal tape or other adhesive A such that the primary flange JF1 is adhesively bonded to the exterior EX of the house/structure wall W when the jamb extender 100 is operatively installed. The adhesive A preferably includes a paper or other release liner RL (shown partially in FIG. 1B) to protect the adhesive A until the release liner RL is removed for use of the window jamb extender 100. In new construction, wherein the primary flange JF1 is exposed, it can also be used as a nailing flange for securing the window jamb extender 100 to the wall W.

In the illustrated embodiment, the body 100B is defined as a one-piece extruded member or "extrusion" using vinyl (polyvinylchloride (PVC)) or another polymeric material. Alternatively, the body 100B can be injection molded, 3-D printed (or manufactured using a similar additive manufacturing method) and/or defined by removing material from a block of polymeric material, wood, foam, cellular PVC, and/or any other suitable material. Alternatively, as described further below, the body 100B comprises a two-piece wood, polymeric and/or other multi-piece structure that is assembled with fasteners, adhesive, a mechanical interfit, and/or any other suitable assembly method from structures that are defined from similar or dissimilar materials relative to each other. In such case, by way of example only, the legs 102A,102B can be separate structures that are connected together, and/or the J-channel portion 100J is a separate extrusion or other structure (or structures) that is (are) defined from the same or different material and adhered, fastened, welded, and/or otherwise connected to the outer face OF of the first leg 102A. In all embodiments, the window jamb extender 100 can be chambered (i.e., include hollow void regions) or be of solid construction. The body 100B is optionally provided in any desired color and/or can be manufactured and or post-processed to include a simulated woodgrain or laminate color coatings, or a matte finish.

As shown in FIGS. 1B and 2, the first and second legs 102A,102B of the window jamb extender 100 (in particular the respective inner faces IF,102Bi thereof) form window receiving region or window frame receiving region R defining a window mounting depth WD between an interior or inner face 102Bi of the second leg 102B and an inner tip 102AT located at the inner end 102Ai of the first leg 102A, wherein the inner tip 102AT is spaced a maximum distance from the inner face 102Bi of the second leg 102B. In other words, the window mounting depth WD is equal to the length of the inner face IF of the first leg 102A when measured between the inner face 102Bi of the second leg 102B and the inner tip 102AT of the first leg 102A which is spaced a maximum distance from the inner face 102Bi of the second leg 102B. This window mounting depth WD is adapted to accommodate a replacement window frame FR (FIG. 2) having any common window frame depth FD as measured between the interior and exterior faces FRI,FRE of the window frame FR without concern for the existing wall jamb mounting depth JMD 106, window frame depth FD of the window being replaced. The frame depth FD is measured adjacent the outer periphery PW of the window frame FR, which is the portion of the frame FR that is received in the window frame receiving region R of the window jamb extender 100. The outer periphery or outer peripheral wall PW of the frame FR extends between and interconnects the interior and exterior faces FRI,FRE of the frame FR.

The replacement window jamb extender 100 produces a clean, efficient and a readymade finished product compared to the other methods or devices available in the market. When installed, the replacement window jamb extender 100 allows a replacement window RW to utilize the same mounting depth JMD of the existing jamb 106, and it does not require extensive finish work as it has an accommodating integral J-channel 100J for the existing siding or other facing/cladding member(s) FM, and comprises a primary flange JF1 including an adhesive A which slides behind existing cladding members FM. To the interior, depending on the existing window and other building materials, minimal to no interior work is required as the same jamb mounting depth JMD of the jamb 106 is used and no drywall or wood trim work is necessary.

FIG. 2 shows a section of the window jamb extender 100 attached to a stud or stud member 116 of the wall that defines the window opening O. The opening O is typically defined by four stud members 116 arranged in a rectangular configuration and the four stud members 116 thus define a periphery PO of the wall opening O. (a gap GX is shown between the window jamb extender 100 and the wall W to facilitate an understanding of the structure, and this gap GX is not present when the window jamb extender 100 is actually installed in the opening O of the wall W and the outer face OF of the first leg 102A is abutted with the stud 116). The window opening O typically results from removal of an existing window that is being replaced, but could alternatively be a new construction window opening. As disclosed in connection with FIGS. 1A & 1B, the window jamb extender 100 is configured to accommodate the frame FR of a replacement window of a predefined geometry (typically a rectangular frame) within an existing jamb mounting depth JMD of a jamb 106 in an already existing wall construction W. The window jamb extender 100 includes the L-shaped frame 102 and a primary flange JF1 with self-adhering and self-sealing tape or other adhesive A. The L-shaped frame 102 is configured to be fixedly attached to a window opening O defined in the wall W, where an inner side of the L-shaped frame 102 as defined by the inner faces IF,102Bi is configured to accommodate the frame FR of the replacement window RW within the existing jamb mounting depth JMD of the wall jamb mounting area 106. The flange JF1 extends from an outer side OF of the L-shaped frame 102, and the flange JF1 is configured to fixedly attach the L-shaped frame 102 on an outer panel 112 attached on an exterior side EX of the wall W. The outer panel 112 is, for example, 0.5-inch ply wood, and the wall W is 4.5 inches in thickness overall including the outer panel 112 and an interior drywall section 114.

In the illustrated embodiment, the inner end 102AT of the L-shaped frame 102 is configured to be abutted with the end of a drywall section 114 extending from the inner side IN of the wall W. The wall W terminates at a nominal 2 inches×4 inches stud member 116 and the drywall section 114 extends over the stud member 116 to define the jamb mounting area 106.

In the illustrated embodiment, the replacement window jamb extender 100 further comprises a counter sunk screw fastener 120 configured to attach the L-shaped frame 102 to the wall stud member 116, where the counter sunk screw/fastener 120 is inserted from the inner side of the L-shaped frame 102 through the inner face IF into the stud 116 such that a head 120*h* thereof is countersunk into the first leg 102A so that the head 120*h* of the screw 120 does not contact or obstruct the window frame FR. The counter sunk screw 120 is screwed to the stud member 116 to increase the stability of the replacement window jamb extender 100 in the opening O of the wall W.

The installation of the replacement window jamb extender 100 comprises different steps. Primarily, the user needs to remove the old window unit ensuring all nails and debris is removed from the space surrounding the window slot opening O. The remaining siding nails are recommended to be removed using a reciprocating saw to obtain a clean surface for the installation of the replacement window jamb extender 100. The previous J-channel attached to the old window unit must be removed, and a sealant is applied to the interior jamb 106 and drywall exterior edge 114. Now, the replacement window jamb extender 100 is cut as per the required dimension.

In other words, the distance between the jambs 106 is measured for the top header and the replacement window jamb extender 100 is cut at an angle of 45 degrees on each side. Then the sealant is applied to the jamb 106 and the drywall exterior edge 114. The sealant can be further applied on a shim if necessary. Pre-drilling of the outside corners is performed and the sealant is applied to the holes and the screws, for example, counter sunk screw 120. Now the liner for the self-adhering seal tape is removed and the replacement window jamb extender 100 is secured with the counter sunk screw 120. Now, the side pieces are measured, as well as top header to sill portion, and then the replacement window jamb extender 100 is cut at 45 degree angles in preparation for a miter joint. Now the other liners for the self-adhering tapes are removed, and the assembly of the replacement window jamb extender 100 is leveled and secured, where a gasket seal or sealant is applied to the corners at the miter joints.

The bottom piece of the replacement window jamb extender 100 is measured, and this bottom sill piece is of similar length as that of the top header piece. The bottom piece of the replacement window jamb extender 100 is slid into place and secured with screws. However, the siding below the window opening may have to be removed and re-applied to properly fit. Finally, the 4 pre-drilled outside corners are filled with decorative plugs or sealant as desired to finish the installation of the replacement window jamb extender 100. As shown in FIG. 3, where adjacent sections of the window jamb extender 100 are abutted to form a miter corner joint CJ a corner screw fastener 121 is optionally used to secure the adjacent section together, and this corner screw fastener is located where it will not interfere with installation of the frame FR of the installed window RW such as in the region where the first leg 102A joins the second leg 102B.

Figure 4A:
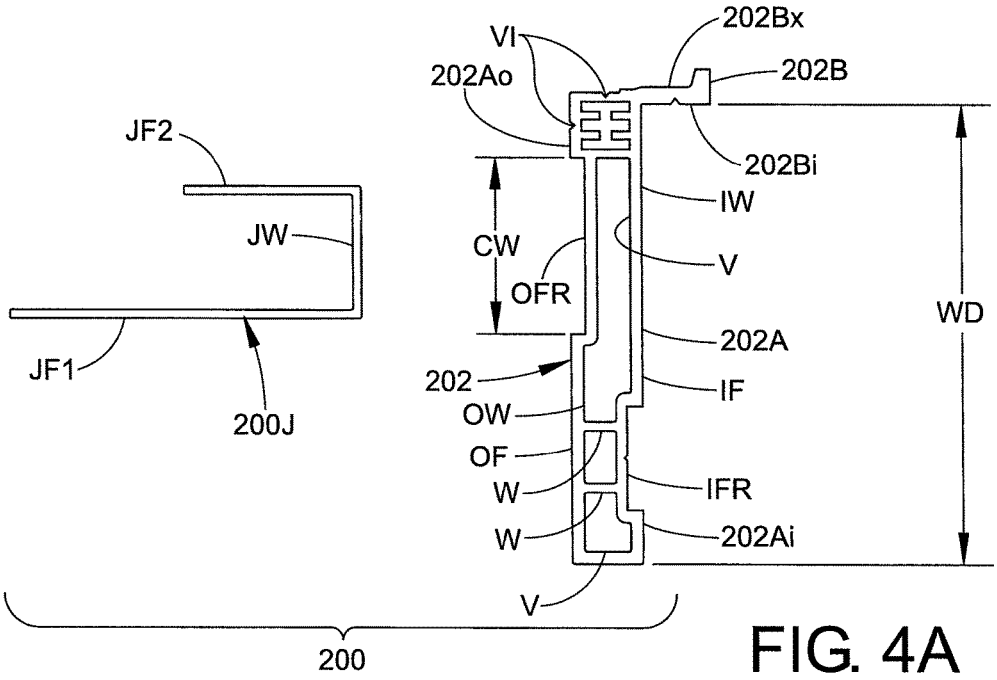
FIG. 4A is an exploded end view of a window jamb extender formed in accordance with a second embodiment of the present development.
Figure 4B:
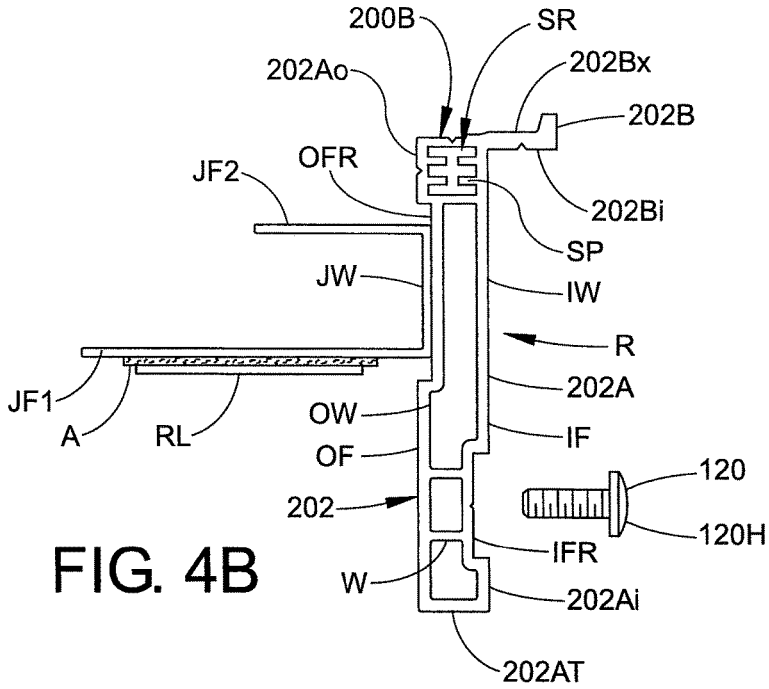
FIG. 4B is similar to FIG. 4A but shows the window jamb extender fully assembled and illustrates an associated fastener used to operatively secure the window jamb extender to the associated wall of a structure.
Figure 4C:
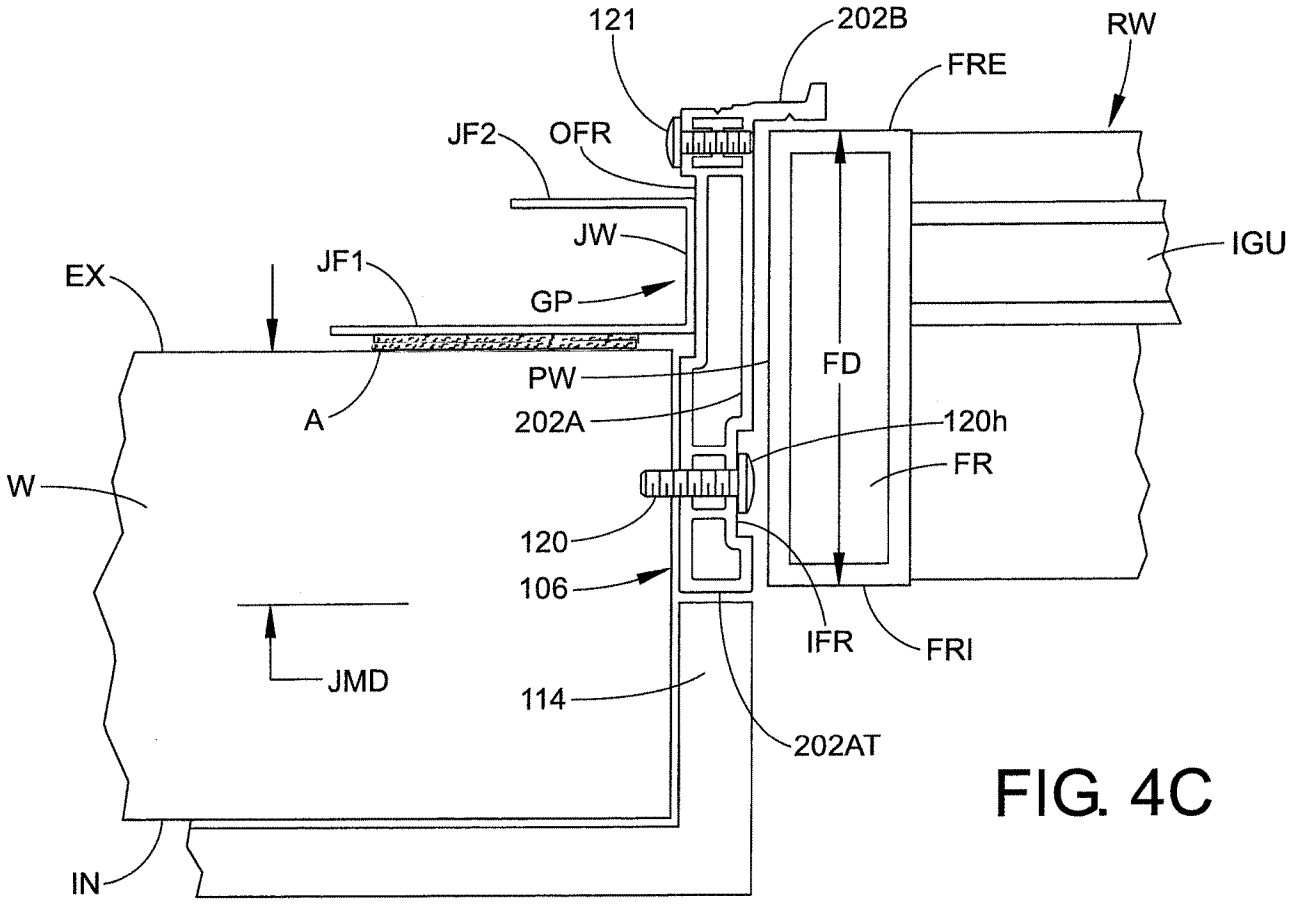
FIG. 4C is similar to FIG. 4B but also shows the window jamb extender operatively installed in a window opening of an associated wall of a house or other structure.
Figure 4D:
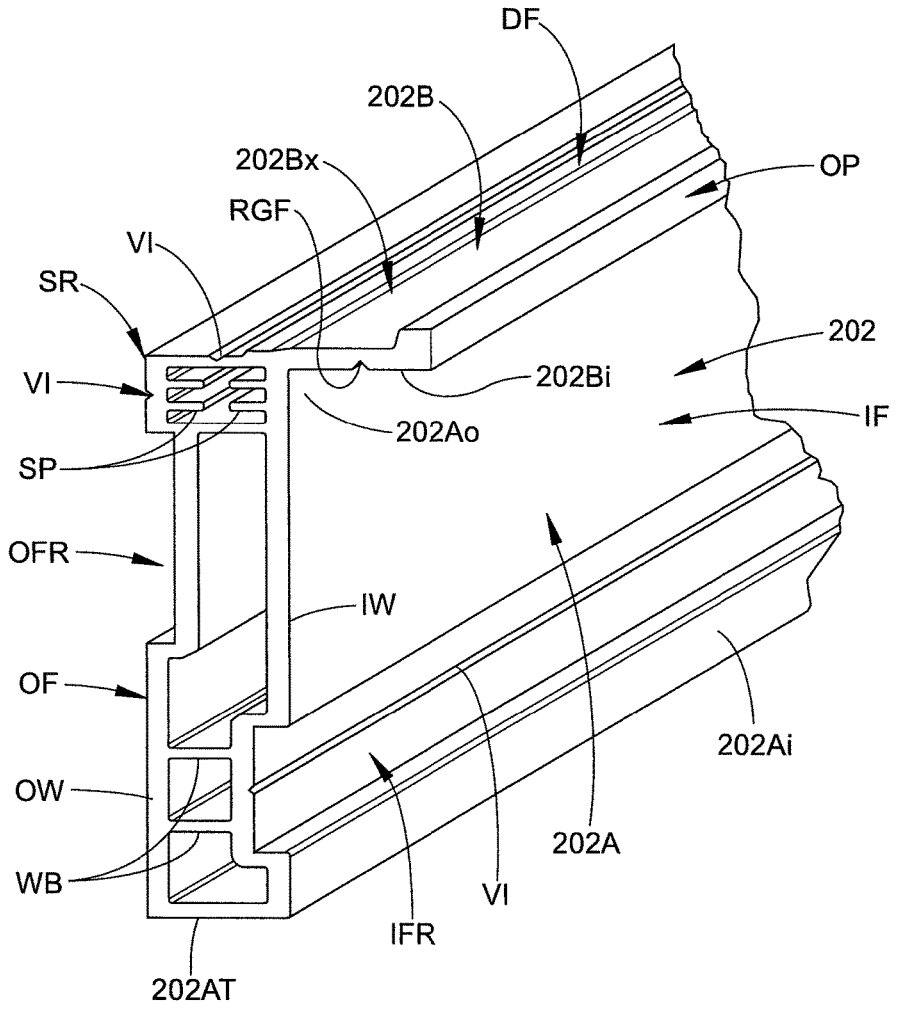
FIG. 4D is an isometric view of the frame portion of the window jamb extender of FIG. 4A cut at a 45 degree angle to form a corner miter edge to be joined with a like frame portion to form a corner miter joint.

FIG. 4A is an exploded end view of a window jamb extender 200 formed in accordance with a second embodiment of the present development. FIG. 4B is similar to FIG. 4A but shows the window jamb extender 200 fully assembled and illustrates an associated fastener 120 used to operatively secure the window jamb extender 200 to the associated wall W of a house or other structure. FIG. 4C is similar to FIG. 4B but also shows the window jamb extender 200 operatively installed in a window opening O of an associated house/structure wall W, and shows an associated window RW operatively engaged with the window jamb extender. FIG. 4D is an isometric view of the frame portion of the window jamb extender of FIG. 4A cut at a 45 degree angle to form a corner miter edge to be joined with a like frame portion to form a corner miter joint. Except as otherwise shown and/or described herein, the window jamb extender 200 is identical to the window jamb extender 100. As such, like reference numbers and letters are used to denote features that correspond to features of the window jamb extender 100, with the numbers being 100 greater than those used in connection with the window jamb extender 100, and in some cases a primed (') suffix is included to indicate a corresponding but modified feature. In other cases, for added clarity, the same reference characters relative to the window jamb extender 100 are used to indicate similar features. The above description of similar features of the window jamb extender 100 relative to the window jamb extender 200 is not necessarily repeated here, and the above description applies to corresponding features unless otherwise noted.

The window jamb extender 200 comprises a two-piece assembled body 200B in which the L-shaped frame 202 and the J-channel 200J are manufactured as separate members or pieces that are assembled together to define the window jamb extender 200. In particular, the J-channel 200J includes a connecting wall JW that extends between and interconnects the primary and secondary flanges JF1,JF2, and this connecting wall is adhered, fastened, and/or otherwise connected to the outer face OF of the first leg 202A to define this embodiment of the window jamb extender 200 as shown in FIG. 4B.

As shown herein, both the L-shaped frame 202 and the J-channel 200J are extruded polymeric structures, but any other suitable material and/or manufacturing techniques can be used to manufacture the L-shaped frame 202 and J-channel 200J, such as extruded aluminum, formed aluminum, wood and the like, and the L-shaped frame 202 and J-channel can be manufactured from different materials, and either can be a one-piece or multi-piece structure. As shown herein, the frame 202 and J-channel 200J are each vinyl (polyvinylchloride (PVC)) extrusions.

The L-shaped frame 202 is shown as a one extruded polymeric structure in which the first leg 202A comprises inner and outer spaced-apart walls IW,OW between which are located a plurality of voids or hollow regions V. The first leg 202A comprises opposite inner and outer ends 202Ai, 202Ao, and the second leg 202B is connected to the first leg 202A at the outer end 202Ao of the first leg 202A, The first leg 202A includes opposite inner and outer faces IF,OF, and the second leg includes opposite inner and outer faces 202Bi,202Bx. The second leg 202B is connected to the first leg 202A adjacent the outer end 202Ao of the first leg 202A and is oriented transversely, preferably perpendicularly, relative to the first leg 202A.

Adjacent the intersection of the first leg 202A and the second leg 202B, the L-shaped frame 202 comprises a screw boss region SR that comprises a hollow void including a plurality of ribs or other projections SP that extend or project inwardly to provide structures to be engaged by the threads of the corner fastener 121 (FIG. 3) when first and second window jamb extenders 200 are arranged to define a corner joint CJ as described above. In this regard, the outer face OF of the first leg 202A and/or the outer face 202Bx of the second leg 202B include a score line, groove, ridge, or other visual indicia VI defined by the L-shaped frame 202, itself, to provide visual guidance to an installer as to the center of the screw boss SR to ensure that the corner fastener 121 is installed in the proper location to engage the projections SP.

The first leg 202A is defined to include an outer face channel or outer face recess OFR that provides a location where the connecting wall JW of the J-channel 200J is adhered or otherwise connected to the outer face OF of the L-shaped frame 202. The outer face recess OFR is recessed, depressed, or offset inwardly relative to an adjacent portion of the outer surface OF includes or defines a width CW that can exactly match the corresponding width of the J-channel connecting wall JW, but preferably the width CW of the outer face recess OFR is larger than the corresponding width of the J-channel connecting wall JW to allow for customization with respect to the exact location of the J-channel 200J on the outer surface OF within an acceptable range as defined by the width CW of the outer face recess ODR. In the illustrated embodiment, the J-channel connecting wall JW is secured to the outer face OF in the outer face recess OFR using double-sided tape, but any other adhesive or other connecting means or structure can be used such as a mechanical engagement, fasteners, welding, and/or other connection techniques. As with the embodiment 100 of the window jamb extender described above, the window jamb extender 200 can be a one-piece structure including both the L-shaped frame 202 and the J-channel 200J in a monolithic structure such as a one-piece extrusion or injection molded structure.

The L-shaped frame 202 also includes an inner face channel or inner face recess IFR defined in the inner face IF of the first leg 202A in a region where the stud fastener 120 is located. The inner face recess IFR is recessed, depressed, or offset inwardly relative to the adjacent portions of the inner face to provide a location for the stud fastener 120 such that the head 120*h* of the fastener 120 is countersunk relative to the adjacent portions of the inner face IF and does not interfere with a window frame FR located adjacent the inner face IF as shown in FIG. 4C. The inner face recess IFR optionally includes a groove or other visual indicia VI that indicates a preferred location (e.g., central location) for insertion of the stud fasteners 120. The first leg 202A preferably includes one or more support webs WB that are aligned with the inner face recess IFR and that extend between and interconnect inner and outer spaced-apart walls IW,OW of the first leg 202A to prevent the inner wall IW from collapsing toward the outer wall OW when the stud fastener 120 is installed.

It can be seen in FIG. 4C that the window jamb extender 200 is used in the same manner as the window jamb extender 100. In particular, the window jamb extender 200 is installed in the existing jamb mounting depth JMD of the wall W and provides a window frame receiving region adjacent its inner faces IF,202Bi that defines a window mounting depth WD that accommodates a frame depth FD that is greater than the existing jamb mounting depth JMD, without disturbing the interior drywall or other interior trim 114 located adjacent the window jamb 106.

Figure 5:
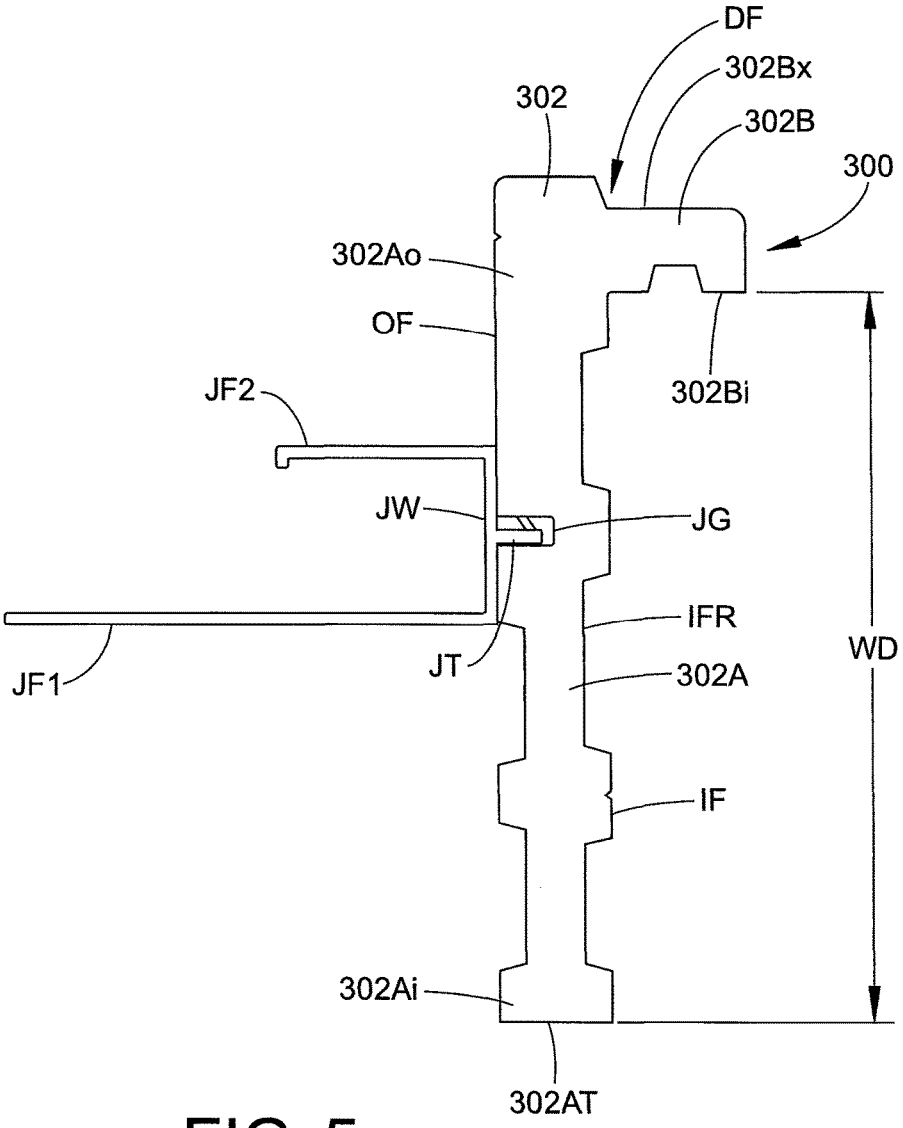
FIG. 5 is an end view of a window jamb extender formed in accordance with a third embodiment of the present development.

FIG. 5 is an end view of a window jamb extender 300 formed in accordance with a third embodiment of the present development. Except as otherwise shown and/or described herein, the window jamb extender 300 is identical to the window jamb extenders 100 and 200. As such, like reference numbers and letters are used to denote features that correspond to features of the window jamb extender 100, with the numbers being 200 greater than those used in connection with the window jamb extender 100, and in some cases a primed (') suffix is included to indicate a corresponding but modified feature. In other cases, for clarity, the same reference characters relative to the window jamb extender 100,200 are used. The above description of similar features of the window jamb extender 100 relative to the window jamb extender 300 is not necessarily repeated here, and the above description applies to corresponding features unless otherwise noted.

The L-shaped frame 302 of the window jamb extender 300 is molded or extruded from a cellular polymeric material such as cellular polyvinylchloride (PVC). The illustrated frame 302 is a monolithic, one-piece structure, but the frame 302 can alternatively be assembled or constructed from multiple substructures of the same or other material. Alternatively, the frame 302 is constructed from one or more pieces of wood, vinyl (PVC) or other materials. The first leg 302A comprises opposite inner and outer ends 302Ai, 302Ao, and the second leg 302B is connected to the first leg 302A at the outer end 302Ao of the first leg 302A, The first leg 302A includes opposite inner and outer faces IF,OF, and the second leg includes opposite inner and outer faces 302Bi,302Bx. The second leg 302B is connected to the first leg 302A adjacent the outer end 302Ao of the first leg 302A and is oriented transversely, preferably perpendicularly (at least for its inner face 302Bi), relative to the first leg 302A. The J-channel 300J is separated constructed from a rigid PVC or other material and the connecting wall JW thereof comprises a projecting tongue JT. The outer face OF of the first leg 302A of the L-shaped frame includes a groove JG that is adapted to receive and retain the tongue JT to operatively connect the J-channel to the L-shaped frame 302. Alternatively, the outer face OF of the L-shaped frame 302 comprises an optional outer face recess OFR as used in the L-shaped frame 202 of the embodiment 200 of FIGS. 4A-4C (or the outer face OF is otherwise conformed with or without an outer face recess OFR), and the J-channel 300J is provided with the same structure as the J-channel 200J and adhered to the outer face OF as described with reference to FIGS. 4A-4C. Two or more parallel grooves JG can optionally be provided such that the tongue JT can be engaged with any desired groove JG to alter the position of the J-channel 300J on the outer face OF. The orientation of the tongue JT and groove JG can be reversed such that the tongue projects from the outer face OF and the groove JG or other structure to receive and retain the tongue is defined in the connecting wall JW. The inner face IF of the first leg 302A includes one or more inner face recesses IFR for indicating the proper location for installation of the stud fasteners 120 and for accommodating the heads 120*h* of the stud fasteners such that the heads 120*h* are countersunk or recessed relative to the adjacent regions of the inner face IF.

As shown in FIG. 4D, the second wall 202B of the frame 202 preferably includes a removal guide feature RGF such as a score line or groove, a rib, printed or other indicia, or the like located thereon, preferably extending along the inner face 202*bi*, that facilitates manual cutting and removing an outer portion OP of the second wall 202B that is spaced or distal from the first wall 202A, for selectively reducing the height of the second wall 202B relative to the first wall 202A as required in the field during installation in order to accommodate moisture/water weep holes, vents, or other features of the window frame FR so that the second wall 202B does not obstruct these features of the frame FR. As shown herein the removal guide feature RGF, shown as a score line/groove, is located so that by cutting the second wall 202B along the removal guide feature RGF and removing the outer (separated) portion OP of the second wall 202B, the height of the second wall 202B relative to the first wall 202A is reduced by half or about half. The second walls 102B,302B of the window jamb extenders 100,300 can optionally also include a corresponding removal guide feature RGF.

The outer or exterior faces 102Bx,202Bx,302Bx of the respective window jamb extenders 100,200,300 optionally include decorative features DF such as paint, film, veneer, or another covering or coating, texturing, faux brick structures such as projections or grooves, and the like to improve the exterior aesthetics of an installed window jamb extender 100,200,300.

The foregoing examples have been provided merely for the purpose of explanation and are in no way to be construed as limiting of the present development disclosed herein. While the development has been described with reference to various embodiments, it is understood that the words used herein are words of description and illustration, rather than words of limitation. Further, although the development has been described herein with reference to particular means, materials, and embodiments, the development is not intended to be limited to the particulars disclosed herein; rather, the development extends to all functionally equivalent structures, methods and uses, such as are within the scope of the appended claims. Those skilled in the art, having the benefit of the teachings of this specification, may affect numerous modifications thereto and changes may be made without departing from the scope and spirit of the development in its aspects.

The invention claimed is:

1. A window jamb extender comprising:

an L-shaped frame including: (i) a first leg extending between opposite inner and outer ends, said inner end of said first leg comprising an inner tip; and, (ii) a second leg connected to the outer end of the first leg and arranged transversely relative to the first leg;

said first leg comprising an outer face adapted to be abutted with an associated wall stud that partially defines a periphery of an opening in an associated wall structure;

said first leg further comprising an inner face that is opposite said outer face of said first leg and that is adapted to lie adjacent an outer peripheral wall of an associated window frame of an associated window to be mounted in the opening of the associated wall structure;

said second leg comprising an inner face adapted to lie adjacent an exterior face of the associated window frame, said inner face of said first leg and said inner face of said second leg forming a window frame receiving region adapted to receive the associated window frame therein, said window frame receiving region defining a window mounting depth defined between the inner face of the second leg and the inner tip of the first leg;

said window jamb extender further comprising a J-channel portion including: (i) a primary flange that projects perpendicularly outward from said outer face of said first leg; (ii) a secondary flange that projects outwardly from said outer face of said first leg, wherein said secondary flange is spaced-apart from said primary flange; and, (iii) a facing installation gap defined between said primary and secondary flanges and adapted to receive an end of an associated facing member therein;

said primary flange located closer to said inner end of said first leg as compared to said secondary flange; and, both said primary and secondary flanges oriented perpendicularly relative to the outer surface of the first leg such that said primary and secondary flanges are arranged parallel to each other and spaced-apart from each other.

2. The window jamb extender as set forth in claim 1, wherein said primary flange is longer than said secondary flange as measured from said outer surface of said first leg.

3. The window jamb extender as set forth in claim 1, wherein said L-shaped frame is provided as a one-piece polymeric construction.

4. The window jamb extender as set forth in claim 3, wherein said one-piece polymeric construction comprises an extrusion.

5. The window jamb extender as set forth in claim 1, wherein said frame and said J-channel portion are provided together as a single one-piece polymeric construction.

6. The window jamb extender as set forth in claim 1, wherein said frame and said J-channel portion are separate structures, and wherein said J-channel portion is connected to said frame.

7. The window jamb extender as set forth in claim 6, wherein said J-channel portion is adhesively secured to the outer face of the first leg of the frame.

8. The window jamb extender as set forth in claim 6, wherein said outer face of said first leg comprises an outer face recess that is depressed relative to an adjacent portion of said outer face to provide a location where said J-channel portion is adhered to said outer face.

9. The window jamb extender as set forth in claim 8, wherein said J-channel portion comprises a one-piece polymeric structure comprising said primary and secondary flanges, said J-channel portion further comprising a connecting wall that extends between and interconnects the primary and secondary flanges, said connecting wall located in said outer face recess and adhesively bonded to said outer face.

10. The window jamb extender as set forth in claim 1, wherein said inner face of said first leg comprises an inner face recess adapted for locating an associated stud fastener for securing said frame to the associated wall stud such that a head of the associated fastener is located in said inner face recess and recessed relative to an adjacent portion of said inner face.

11. The window jamb extender as set forth in claim 1, wherein an inner face of said primary flange that is oriented away from said secondary flange comprises an adhesive thereon.

12. The window jamb extender as set forth in claim 11, wherein said adhesive is covered by a removable release liner.

13. The window jamb extender as set forth in claim 1, wherein said first leg is adapted to partially overlap the associated wall stud and the primary flange is adapted to abut an exterior surface of the associated wall structure such that said outer end of said first leg is spaced outwardly from said wall stud and spaced outwardly from an exterior surface of the associated wall.

14. The window jamb extender as set forth in claim 1, wherein:

the associated window frame comprises a frame depth defined as a thickness of the associated window frame between its interior and exterior faces adjacent its outer periphery;

said window mounting depth defined between said inner face of the second leg and the inner tip of the first leg is equal to or greater than said frame depth.

15. A window jamb extender comprising:

a frame including: (i) a first leg including opposite inner and outer ends; and, (ii) a second leg connected to the outer end of the first leg and arranged transversely relative to the first leg;

said first leg comprising an outer face adapted to be abutted with an associated wall stud that partially defines a periphery of an opening in an associated wall structure;

said first leg comprising an inner face that is opposite said outer face of said first leg and that is adapted to lie adjacent an outer peripheral wall of an associated window frame, and said second leg comprising an inner face adapted to lie adjacent an exterior face of the associated window frame;

said window jamb extender further comprising a J-channel portion including: (i) a primary flange that projects outwardly from said outer face of said first leg; and, (ii) a secondary flange that projects outwardly from said outer face of said first leg, wherein said secondary flange is spaced-apart from said primary flange;

wherein said frame and said J-channel portion are separate structures, and said J-channel portion is connected to said frame;

and wherein said first leg of said frame comprises spaced-apart inner and outer walls and one or more support webs that extend between and interconnect the inner and outer walls.

16. The window jamb extender as set forth in claim 15, wherein said frame comprises a one-piece extruded polymeric structure.

17. The window jamb extender as set forth in claim 16, wherein said frame further comprises a screw boss region that comprises a hollow void including a plurality of projections that extend inwardly to provide structure to be engaged by an associated miter corner fastener when said window jamb extender is arranged to define a miter corner joint, said screw boss region located adjacent an intersection of the first leg and the second leg.

18. A window jamb extender comprising:

an L-shaped frame including: (i) a first leg extending between opposite inner and outer ends, said inner end of said first leg comprising an inner tip; and, (ii) a second leg connected to the outer end of the first leg and arranged transversely relative to the first leg;

said first leg comprising an outer face adapted to be abutted with an associated wall stud that partially defines a periphery of an opening in an associated wall structure;

said first leg further comprising an inner face that is opposite said outer face of said first leg and that is adapted to lie adjacent an outer peripheral wall of an associated window frame of an associated window to be mounted in the opening of the associated wall structure;

said second leg comprising an inner face adapted to lie adjacent an exterior face of the associated window frame, said inner face of said first leg and said inner face of said second leg forming a window frame receiving region adapted to receive the associated window frame therein, said window frame receiving region defining a window mounting depth defined between the inner face of the second leg and the inner tip of the first leg;

said window jamb extender further comprising a primary flange that projects perpendicularly outward from said outer face of said first leg, said primary flange comprising an inner face adapted to be abutted with an exterior surface of the associated wall structure.

19. The window jamb extender as set forth in claim 18, further comprising a secondary flange that projects outwardly from said outer face of said first leg, wherein:

said secondary flange is spaced-apart from said primary flange;

said primary flange is located closer to said inner end of said first leg as compared to said secondary flange;

both said primary and secondary flanges are oriented perpendicularly relative to the outer surface of the first leg such that said primary and secondary flanges are parallel and spaced-apart relative to each other; and, a facing installation gap is defined between said primary and secondary flanges and adapted to receive an end of an associated facing member therein.

* * * * *